US006741044B2

(12) United States Patent
Komori et al.

(10) Patent No.: US 6,741,044 B2
(45) Date of Patent: May 25, 2004

(54) LAMP LIGHTING CONTROLLING APPARATUS AND LIGHT EMITTING APPARATUS

(75) Inventors: Minoru Komori, Kanagawa (JP); Hirotoshi Sugimoto, Kanagawa (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/448,013

(22) Filed: May 30, 2003

(65) Prior Publication Data

US 2003/0222602 A1 Dec. 4, 2003

(30) Foreign Application Priority Data

May 31, 2002 (JP) ..... 2002-158978
Mar. 19, 2003 (JP) ..... 2003-075157

(51) Int. Cl.[7] ..... G05F 1/00

(52) U.S. Cl. ..... 315/308; 315/241 P; 355/81; 355/67; 355/69; 396/166; 396/108

(58) Field of Search ..... 315/241 P, 289, 315/224, 291, 352, 308; 355/63, 67, 69, 71, 81, 401, 402; 396/108, 166, 169

(56) References Cited

U.S. PATENT DOCUMENTS 5,721,608 A * 2/1998 Taniguchi ..... 355/53
5,880,816 A * 3/1999 Mimura et al. ..... 355/53
6,002,467 A * 12/1999 Nishi et al. ..... 355/61

FOREIGN PATENT DOCUMENTS

EP 1 272 011 A1 1/2003
JP 06-120103 A1 4/1994
JP 10-247619 A1 9/1998

* cited by examiner

*Primary Examiner*—Haissa Philogene
(74) *Attorney, Agent, or Firm*—Rader, Fishman & Grauer PLLC

(57) ABSTRACT

When a lamp is turned on and a wafer is placed on a light exposure surface, a controlling unit opens a shutter plate so that light is emitted on the light exposure surface and an illuminometer receives the light. An accumulated light amount measuring unit converts illumination intensity measured by the illuminometer to an accumulated light amount. The controlling unit turns off the lamp by sending a lamp OFF signal to a power supplying unit. At the same time, the controlling unit sends a shutter closing command to the power supplying unit. After the shutter is closed, the controlling unit relight the lamp by sending a lamp ON signal to the power supplying unit.

6 Claims, 11 Drawing Sheets

Shutter opened

Shutter closed

FIG. 11

Lamp stable period — Confirmation of re-lighting by input of turning on command after input of turning off command Condition of measurement Input voltage: 180VAC
Lamp: PC-430BY

| Period from input of turning off command input of to turning on command | Light probability |
|---|---|
| 2 | 5/5 |
| 3 | 5/5 |
| 4 | 5/5 |
| 4. 5 | 3/5 |
| 5 | 0/5 |

LAMP LIGHTING CONTROLLING APPARATUS AND LIGHT EMITTING APPARATUS

TECHNICAL FIELD OF THE INVENTION

This invention relates to a lamp lighting controlling apparatus and light emitting apparatus used for an exposure apparatus for exposing a substrate such as a display board, print circuit board, semiconductor wafer etc., especially, to a lamp lighting controlling apparatus and a light emitting apparatus for precisely controlling desired accumulated light amount on a work piece or work pieces suitable for sputtering etc.

DESCRIPTION OF RELATED ART

In such an exposure apparatus for exposing a substrate or substrates such as a display board, a print circuit board, a semiconductor wafer etc., a light emitting apparatus for emitting exposure light is provided.

In FIG. 8, the structure of such the light emitting apparatus 10 is shown.

As shown in the figure, in a light emitting unit 10, optical components such as a discharge lamp 1, e.g. an ultrahigh-pressure mercury lamp, that emits exposure light, a condensing mirror 2 for condensing light from the discharge lamp 1, a first plane mirror 4 (a reflecting mirror) for reflecting the light from the discharge lamp 1 and the condensing mirror 2, an integrator lens 5 for making the illumination distribution uniform on a light exposure surface, a second plane mirror 7 (a reflecting mirror) for conducting light to a light outgoing window, and a collimator lens 8 for forming light emitted from the light outgoing window into parallel light.

A shutter mechanism 6 comprises a shutter plate 61 (a douser), a shutter driving unit 62, and a shutter opening/closing detecting sensor 63.

The shutter plate 61 is driven by the shutter driving unit 62, and the light emitting amount (light exposure amount) emitted on the light exposure surface is controlled by inserting the shutter plate 61 in the optical path or removing the plate 61 from the optical path.

A open/close state of the shutter 61 is detected by the shutter opening/closing detecting sensor 63. The light exposure surface may be a mask surface on which a pattern of circuit etc. is formed or a work surface on which a photosensitive agent is coated and formed.

An illuminometer 11 provided behind the second plane mirror 7, receives light through a light transmission portion such as a pinhole(s) provided on the second plane mirror 7. Output of the illuminometer 11 is sent to an accumulated light amount measuring unit 12.

In the accumulated light amount measuring unit 12, accumulated light amount is calculated by accumulating light amount measured by the illuminometer 11.

The lamp lighting controlling apparatus 20 comprises a lamp lighting power source 21 for supplying power to turn on the lamp 1, and a controlling unit 22.

The lamp lighting power source 21 has a power supply unit 21*a* and a start-up circuit 21*b* (a starter). The power supply unit 21*a* converts AC into DC and supplies it to the lamp 1. Power supplied to the lamp 1 is controlled by the lamp lighting power source 21.

The start-up circuit 21*b* generates high voltage so that dielectric breakdown takes place between electrodes of the lamp 1 at the start of discharge lamp lighting.

In turning on a short-arc discharge lamp such as an ultrahigh-pressure mercury discharge lamp, high voltage is instantaneously impressed between the electrodes at a frequency greater than 1 MHz so that the dielectric breakdown takes place and the discharge lamp is turned on. The start-up circuit is called an ignitor, or a starter.

The controlling unit 22 receives output of a controlling section 23 for controlling the exposure apparatus, and controls opening of the shutter plate 61 according to output from the controlling section 23, the accumulated light amount measuring unit 12 and the shutter opening/closing detecting sensor 63 or controls to turn on and off the lamp 1 by controlling the lamp lighting power source 21.

In the light emitting unit 10, the lamp 1 is always tuned on.

In order to make the accumulated light amount emitted on the work piece having the light exposure surface uniform, the controller 22 controls opening of the shutter plate 61 during a period from the opening of the shutter (the start of emission) to the closing of the shutter (end of emission) by controlling the shutter mechanism 6 according to the output of the accumulated light amount measuring unit 12 so that accumulated light amount (light exposure amount) on the light exposure surface becomes a desired value.

The lamp 1 is always turned on because in general once the lamp 1 including mercury in inclusive gas is turned off, the lamp 1 cannot be re-lighted easily since the dielectric breakdown voltage is high while the temperature of the lamp is still high, therefore, the lamp 1 would not be tuned on unless the lamp is cooled off so that the dielectric breakdown voltage becomes sufficiently low.

"Relight" means that power is applied to the lamp 1 to turn on the lamp after the lamp is turned off but while the lamp does not sufficiently cool down.

In FIGS. 9A and 9B, an example of the shutter mechanism 6 for the light emitting apparatus is shown.

The shutter plate 61 has light transmission portions 64 and light blocking portions 65. The shutter plates 61 are unidirectionally (in a direction shown as an arrow) rotated with respect to a rotation axis 66 by the shutter driving unit 62 such as a motor (not shown).

When the shutter plate 61 is in a position shown in FIG. 9A, light passes through the light transmission portion 64. When the shutter plate 61 is in a position shown in FIG. 9B, the light is blocked by the light blocking portions 65.

Description of the conventional accumulated light exposure amount control in the light emitting apparatus shown in FIG. 8 will be given below.

At the beginning, the lamp 1 is turned on. When the lighting becomes stable and a work piece such as a wafer etc. is placed on the light exposure surface, the controlling unit 22 sends a shutter opening command to the shutter driving unit 62. And then the shutter plate 61 is opened and light is emitted from the light outgoing window and then the wafer etc. placed on the light exposure surface is exposed.

The accumulated light exposure amount on the light exposure surface is controlled as described below.

As shown in FIG. 8, the illuminometer 11 is provided behind the second plane mirror 7, and light transmitted through the light transmission portion such as a pinhole(s) etc. provided on part of the second plane mirror 7 is entered into the illuminometer 11.

The illuminometer 11 is not placed on the light exposure surface since the shadow of the illuminometer 11 appears against the work piece (a mask etc.) during an actual exposure operation if the illuminometer 11 is placed on the light exposure surface and it is impossible to measure the illumination intensity.

In case that the illuminometer 11 receives the light transmitted through the light transmission portion, it is necessary to be set so that accumulated light amount exposed on the light exposure surface and accumulated light amount measured from the amount of light received by the illuminometer 11 are equivalent.

In particular, it is confirmed that they are in proportionality relation, and the constant of proportion is obtained.

An illumination intensity signal from the illuminometer 11 is input in the accumulated light amount measuring unit 12 and converted into accumulated light exposure amount.

The controlling unit 22 sends a shutter closing command to the shutter driving unit 62 so that the accumulated light amount is controlled to a predetermined value by predictive control described below and closes the shutter plate 61. The operation constitutes one cycle of exposure process for the wafer etc.

As shown in FIGS. 9A and 9B, the shutter plate 61 is rotated. Therefore, it takes minimum amount of time to completely block light trace from a time when the shutter opening command is input to a time when the shutter plate 61 is completely opened and complete light passes through the light transmission portion, or from a time when the shutter closing command is input to a time when the shutter plate is completely closed.

The operation period of the shutter is about 20 ms even though driving mechanism capable of operating at high speed is used.

In FIG. 10, change of illumination intensity (that is, intensity change of a light signal from the illuminometer 11) from a time when the shutter is opened to a time when the shutter is closed is shown.

In the figure, a section marked with diagonal lines shows accumulated light exposure amount. The curved line showing illumination intensity is waved because of flicker (ripple) of light emitted from the lamp 1. This ripple causes subtle change of illumination intensity on the light exposure surface.

The light exposure amount in a period during which the shutter is in operation (a period from the beginning of shutter opening operation to the completion of the opening operation), is shown as a right side triangle portion B.

The accumulated light exposure amount marked with the diagonal lines in FIG. 10 is controlled to a desired light exposure amount by controlling the opening and closing of the shutter. Description of the control is given below.

Illumination intensity is measured by the illuminometer 11 from a time when the shutter command signal is sent to the shutter driving unit 62 (the start of a shutter opening operation), and light amount is accumulated in the accumulated light amount measuring unit 12 and the accumulated light amount is calculated.

However, if a shutter closing operation starts when the light exposure reaches a desired value, excessive light amount is exposed since the right triangle portion B shown FIG. 10 is added to the accumulated light amount.

SUMMARY OF THE INVENTION

Therefore, in the controlling unit 22, the light amount A during the shutter opening operation is stored based on output of the accumulated light amount measuring unit 12.

Assuming that the light exposure amount A in the shutter opening operation and the light exposure amount B in the shutter closing operation are equal (A=B), the accumulated light exposure amount reaches a value less than a desired value by the light exposure amount A, the controlling unit 22 sends a shutter closing command to the shutter driving unit, the shutter plate 61 starts a closing operation.

That is, based on the assumption of A=B, the predictive control is carried out. The calculation of light exposure amount in the shutter opening operation is performed every exposure.

Thus, the light exposure amount is controlled based on the prediction that the light exposure amount A during the shutter opening operation and the light exposure amount B during the shutter closing operation are equal.

To satisfy the requirement of A=B, the shutter opening speed and the shutter closing speed must be equal and also ripple of light must be equal.

It is difficult to completely eliminate the ripple and it is impossible to control the size or frequency of the ripple. Therefore, the light exposure amount A and the light exposure amount B are subtly different because of changes of the ripple (that is subtle changes of the illumination intensity).

Also, it is difficult to completely eliminate fluctuation in a shutter mechanism driving operation, e.g. fluctuation of a period from input of the shutter opening command or input of the shutter closing command in the shutter mechanism 6, to the start of the shutter opening or closing operation. In FIG. 10, the fluctuation is shown as a portion marked with diagonal dash lines.

More precisely, when the operation period of the shutter is 20 ms, there is an error of about ±0.2 ms. This will cause a light exposure amount error of ±1% or more during the shutter closing operation. Therefore, it is difficult to control such light exposure amount error to less than ±1% and there is about 0.5% of fluctuation in the light exposure amount as a whole.

In recent years, it is increasingly necessary to precisely control the light exposure amount in order to carry out light exposure with miniaturization and high precision which is suitable for network operations.

Specifically, in the recent years, high-sensitivity of photosensitive material (resist) for light exposure has been advanced in order to carry out light exposure for a short time with a small amount of light exposure.

Conventionally, in the light exposure control, 2% of error was permissible, however, it is desired to control the error to less than 1%, preferably, less than 0.5%.

It is an object of the present invention to precisely control light exposure amount in carrying out light exposure on a substrate such as a semiconductor wafer.

It is another object of the present invention to minimize fluctuation of the light exposure amount due to ripple of light from the lamp and fluctuation of an operation of shutter mechanism.

In the conventional light emitting apparatus as described above, the lamp is always turned on. This is why in general once the discharge lamp including mercury in enclosed gas is turned off, the lamp will not be relighted immediately, since dielectric breakdown voltage is high while the lamp is still hot.

However, in an actual experiment for relighting such an ultrahigh-pressure mercury lamp, it was found that the lamp can be relighted within a limited time.

In FIG. 11, an experiment result of relightable time in the experiment in which a 4 W ultrahigh-pressure mercury lamp is used is shown.

As understood from the figure, it is possible to relight the lamp within 4 seconds after the lamp is turned off.

This is one of examples but any discharge lamp may be relighted if it is relighted within a short time.

It is presumed that the dielectric breakdown voltage is still low, if vapor of mercury generated in the lamp case when the lamp is tuned on does not disappear, that is, the vapor remains for a while after the lamp is turned off.

On the other hand, if the lamp is tuned off in such manner described above, the lamp must be relighted within the period during which the relighting is possible.

Also high voltage must be impressed to the lamp from the starter (start-up circuit).

However, if lighting to reduce power is maintained, the restriction that the lamp must be relighted within the time during which the lamp can be relighted is removed. Further, since it is not necessary to impress high voltage to the lamp from the starter (start-up circuit), design freedom is increased as to light exposure processing control in the apparatus.

The present invention solves the problems as set forth below.

Using the characteristic of a discharge lamp, accumulated light exposure amount is controlled to a desired value by turning off the lamp for a short time when the accumulated light exposure amount reaches a desired amount and the shutter is closed during the short period.

That is, during a period of the discharge lamp's lighting, a shutter opening command is output to the shutter driving mechanism 6, and light is exposed on the light exposure surface. When the accumulated light amount measured by the accumulated light amount measuring unit reaches a predetermined value, a lamp OFF signal is output to the lamp lighting power source 21, and light emission on the light exposure surface is stopped, and, at the same time, a shutter closing command is output to the shutter mechanism 6 and then a lamp relighting command is output to the lamp lighting power source after the shutter is closed and within the period during which relighting of the discharge lamp is possible.

Thus, within the turning off period during which relighting of the discharge lamp is possible, the closing of the shutter plate 61 is completed and relighting is carried out.

In other words, the lamp turning off period is at least longer than a shutter closing period and shorter than the period during which relighting is possible.

Thus, it is possible to precisely control the light exposure amount without effects of ripple of light from the discharge lamp and/or fluctuation of a shutter mechanism driving operation.

The present invention also solves the problems as set forth below.

When the shutter closing operation takes place, illumination intensity on the light exposure surface is reduced by decreasing power supplied to the lamp to less than the rated apparent power. After the shutter closing operation is completed, the power supplied to the lamp is set back to the rated apparent power before the discharge lamp is turned off.

For example, if the power supplied to the lamp 1 is reduced to 1/n, the illumination intensity is proportional to it and reduced to 1/n.

A predictive control in which $(1/n)\times A=B$ is assumed is carried out.

That is, during lighting of the discharge lamp 1, a shutter opening command is output to the shutter mechanism 6 and light is emitted onto the light exposure surface.

Assuming that 1/n of exposure amount A during the period of the shutter opening operation and the exposure amount B during the shutter closing operation are equal $[(1/n)\times A=B]$, when the accumulated light exposure amount, measured by the accumulated light amount measuring unit 12, from the start of the shutter opening operation, reaches a certain light exposure amount which is less than the predetermined exposure amount by $(1/n)\times A$, a command for reducing power supplied to the discharge lamp 1 is sent to the lamp lighting power source 21 so that intensity of light emission on the light exposure surface is decreased. At the same time, a shutter closing command is sent to the shutter mechanism 6.

After the shutter closing operation is completed, power supplied to the discharge lamp 1 is increased to the rated apparent power before the lamp 1 is turned off.

The value "n" of [1/n rated apparent power] is set not to turn off the lamp 1 during the shutter closing operation. For example, preferably, 1/n equals to about 0.1–0.3.

Since the lower the power supplied to the lamp 1 is with the value "n" increased, the less the error of the light exposure amount is, if n=10, it is possible to make the error of the light exposure amount the least.

Since the light exposure amount is small during the shutter closing operation since the intensity of light emission onto the light exposure surface during the shutter closing operation is low, it is possible to output the shutter closing command when the accumulated light exposure amount measured by the accumulated light exposure measuring unit 12, reaches a predetermined light exposure amount without the prediction control described above if such light exposure amount does not become problematic.

As described above, if the illumination intensity is set to 1/n in the shutter closing operation, the error of the light exposure amount generated in the portion B described above becomes 1/n of the conventional error. Therefore, the 2% of the error in the conventional apparatus becomes 2/n % in the present invention.

When the lamp 1 is turned off as in the first method described at above, it is possible to eliminate the errors of light exposure amount, but the lamp 1 must be relighted within the period during which relighting is possible.

As in the second method, when the power supplied to the lamp 1 is lowered and the lighting is maintained, the restriction that the lamp 1 must be relighted within the period during which relighting is possible is eliminated and freedom of design as to the exposure processing control of the apparatus is increased.

Also it is not necessary to relight the lamp 1 by impressing high voltage to the lamp 1 by the starter (start-up circuit).

DESCRIPTION OF THE DRAWINGS

The present inventions will now be described by way of example with reference to the following figures in which:

FIG. 11 is a chart showing the probability of lighting during a period from turning off of the lamp to relighting.

DETAILED DESCRIPTION OF THE INVENTION

An embodiment of the present invention is described based on the figures.

An example in which a light emitting device and a lamp lighting controlling apparatus are applied to a light exposure device (stepper) for sequentially exposing each of divided areas is described below.

As a discharge lamp used as a light source of the stepper, a ultrahigh pressure mercury lamp or a xenon mercury lamp (Xe-Hg lamp; DEEP UV LAMP™) or the like is used and hereinafter referred to as a lamp 1.

Figure 1:
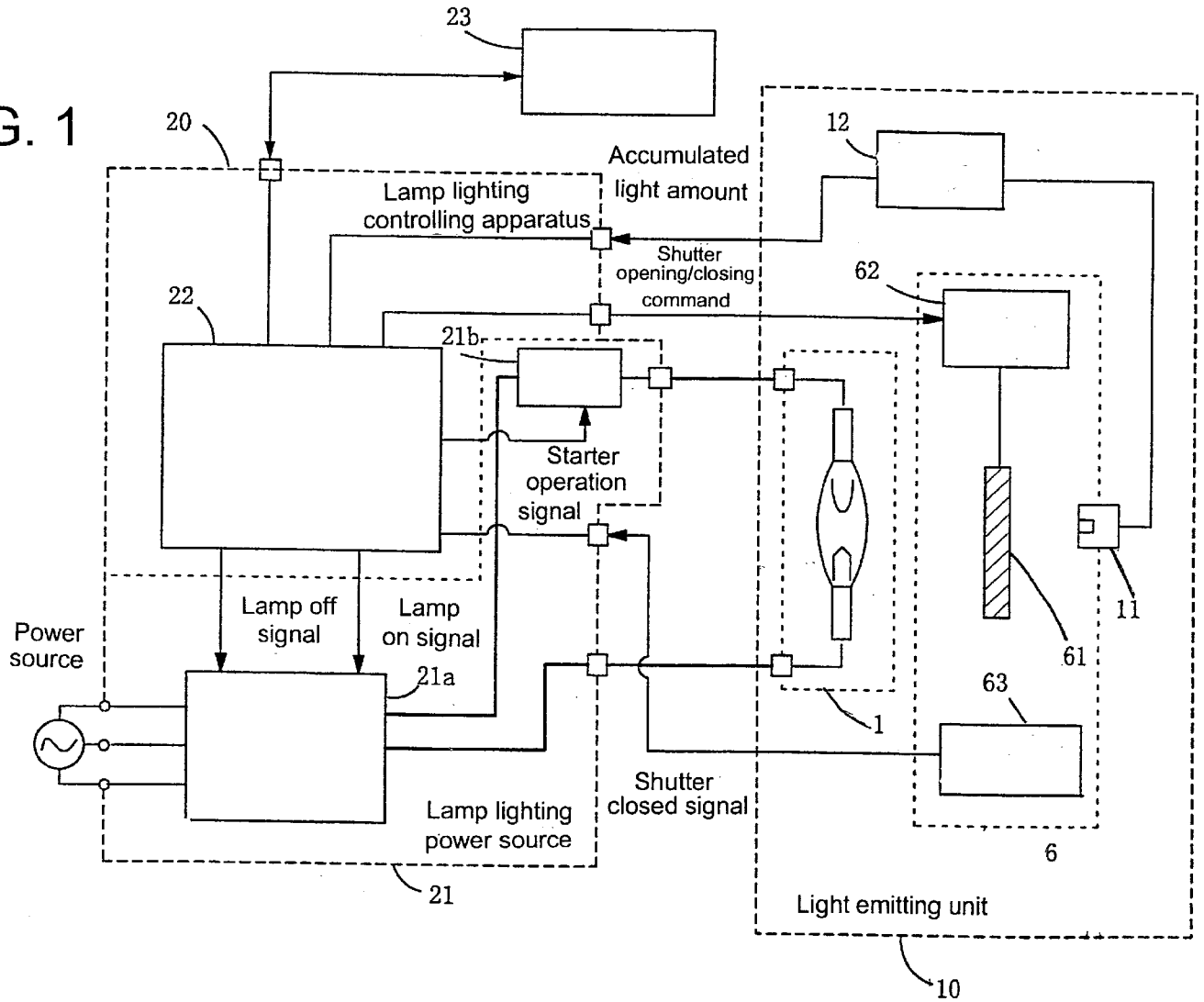
FIG. 1 is a schematic diagram of a light emission unit and a lamp lighting controlling apparatus according to a first embodiment of the present invention.

In FIG. 1, the structure of the first embodiment is shown.

In FIG. 1, as to the light emitting unit 10, only the lamp 1, an illuminometer 11, an accumulated light amount measuring unit 12, a shutter mechanism 6, a shutter plate 61, and a shutter opening/closing sensor 63 are shown. However, as shown in FIG. 8, optical components such as a condensing mirror 2 for condensing light from the lamp 1, a first plane mirror 4 for reflecting the light from the lamp 1 and the condensing mirror 2, an integrator lens 5 for making the illumination distribution uniform on a light exposure surface, a second plane mirror 7 for conducting light to a light outgoing window, and a collimator lens 8 for forming light emitted from the light outgoing window into parallel light are provided.

As described above, the illuminometer 11 is provided behind the second plane mirror 7, and receives light from a light transmission portion such as a pinhole provided on the plane mirror 7 and then sends information of the received light amount to the accumulated light amount measuring unit 12. The accumulated light amount measuring unit 12 integrates output of the illuminometer 11.

Figure 9A:
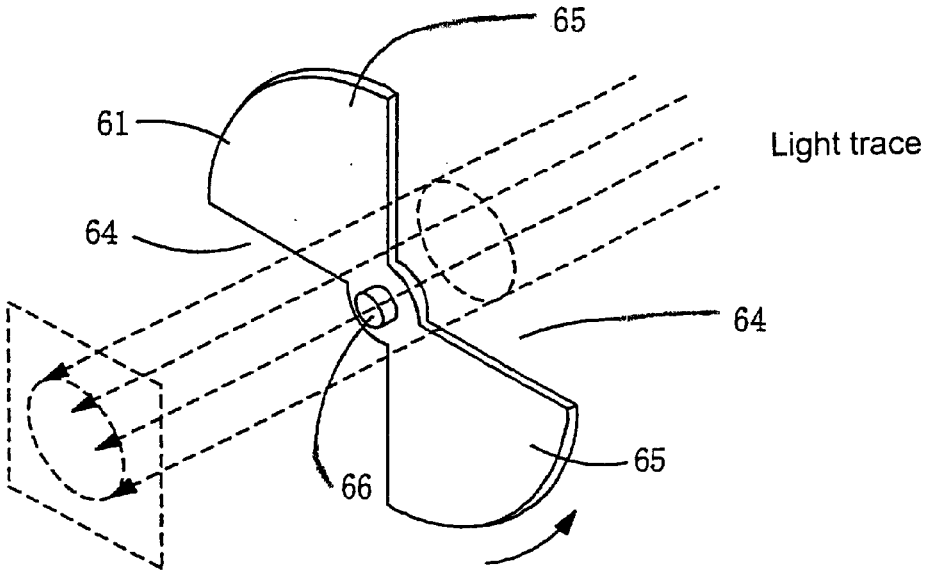
FIGS. 9A and 9B is a diagram of an example of a shutter mechanism 6 used for the light emitting device.
Figure 9B:
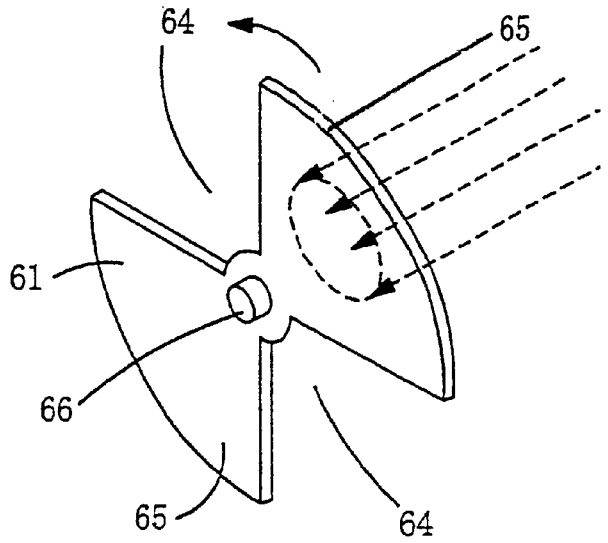
Figure 10:
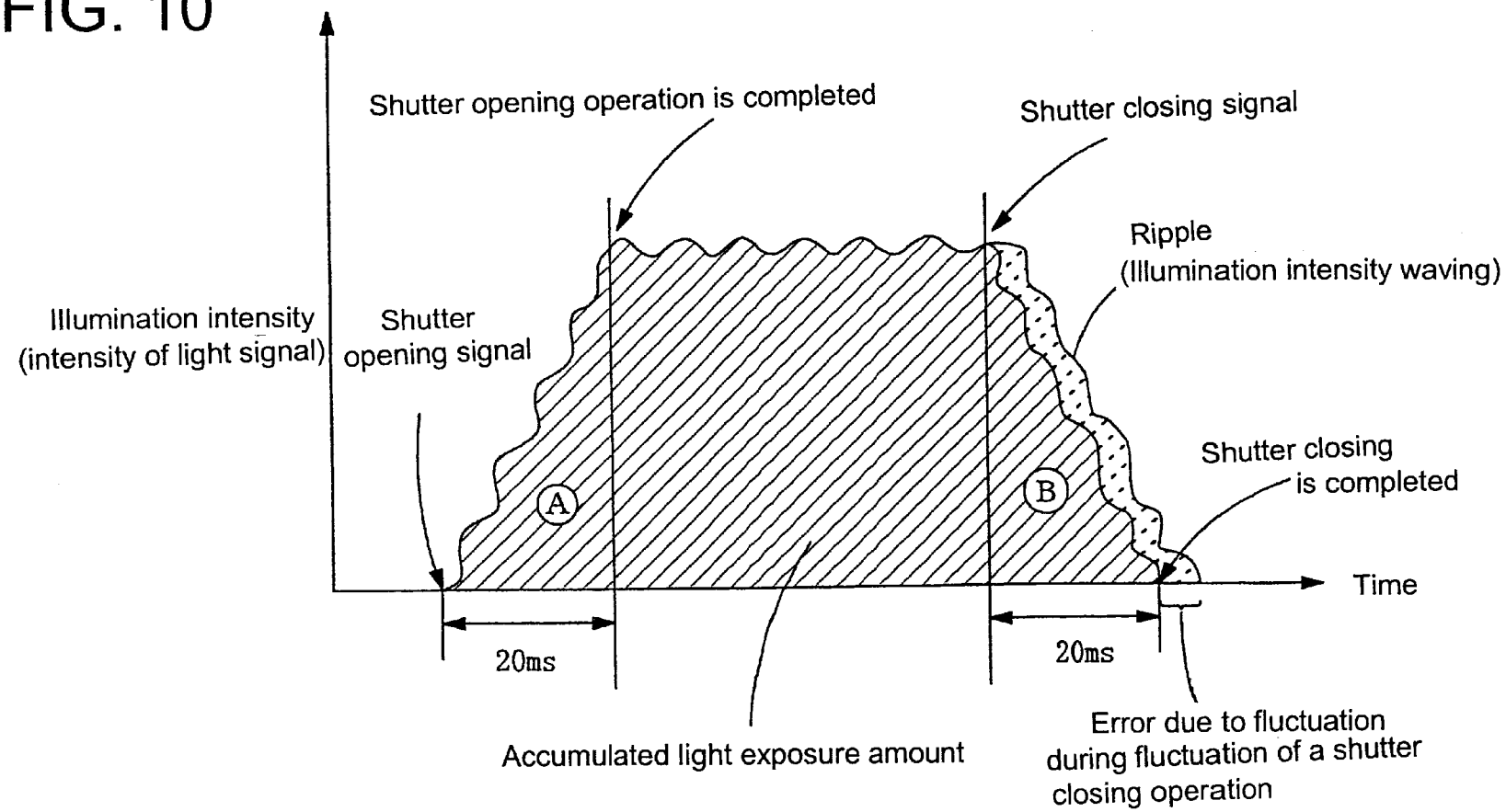
FIG. 10 is a graph showing change of illumination intensity on the light exposure surface during a period from opening of shutter to closing of the shutter according to the first embodiment of the present invention.

A shutter mechanism 6, is for example, the same as one shown in FIG. 9 and in FIG. 1, a shutter opening/closing detecting sensor 63 is provided for detecting opening and closing of the shutter plate 61.

Figure 8:
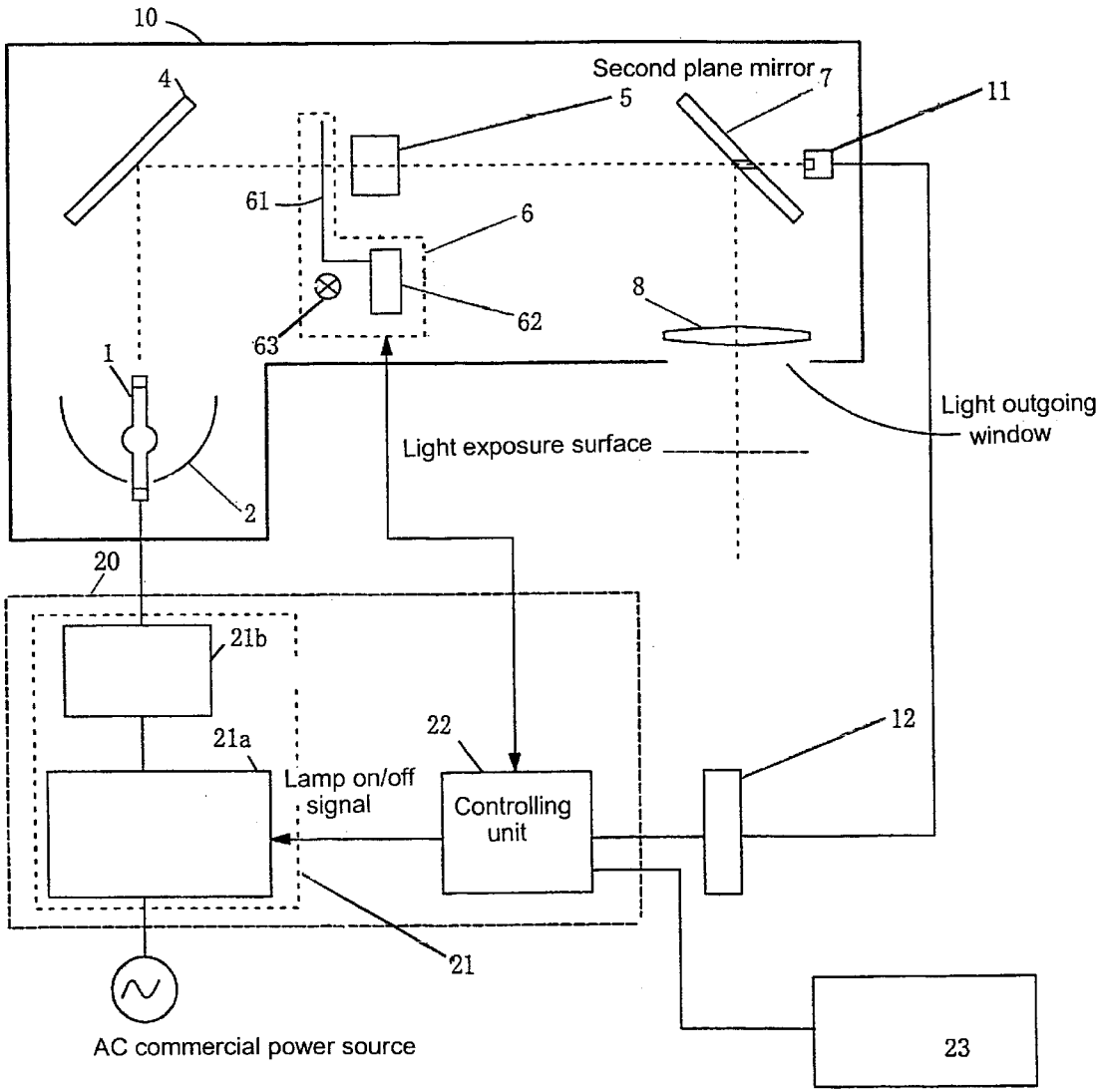
FIG. 8 is a diagram showing the structure of a light emitting device.

A work area which is not shown in FIGS. 1 and 8, is provided below the light outgoing window of the light emitting unit 10. A wafer is placed on the light exposure surface of the work area. Exposure light is emitted through a mask not shown from the light emitting unit 10 on a certain exposure area of the wafer. Thus, exposure process is carried out on the exposure area of the wafer.

After the exposure of the certain exposure area, the wafer is moved so that the next exposure area of the wafer is exposed. After that, each exposure area of the wafer is sequentially exposed by moving the wafer as well.

The lamp lighting power source 21 for supplying power to turn on the lamp 1, as described above, has a power supply unit 21*a* and a start-up circuit 21*b* (hereinafter referred to a starter). The Power supply unit 21*a* converts AC from a commercial power source 211 into DC and controls power to be supplied to the lamp 1. The start-up circuit 21*b* generates high voltage for inducing dielectric breakdown between electrodes of the lamp 1 at the beginning of discharge lamp lighting.

Figure 2:
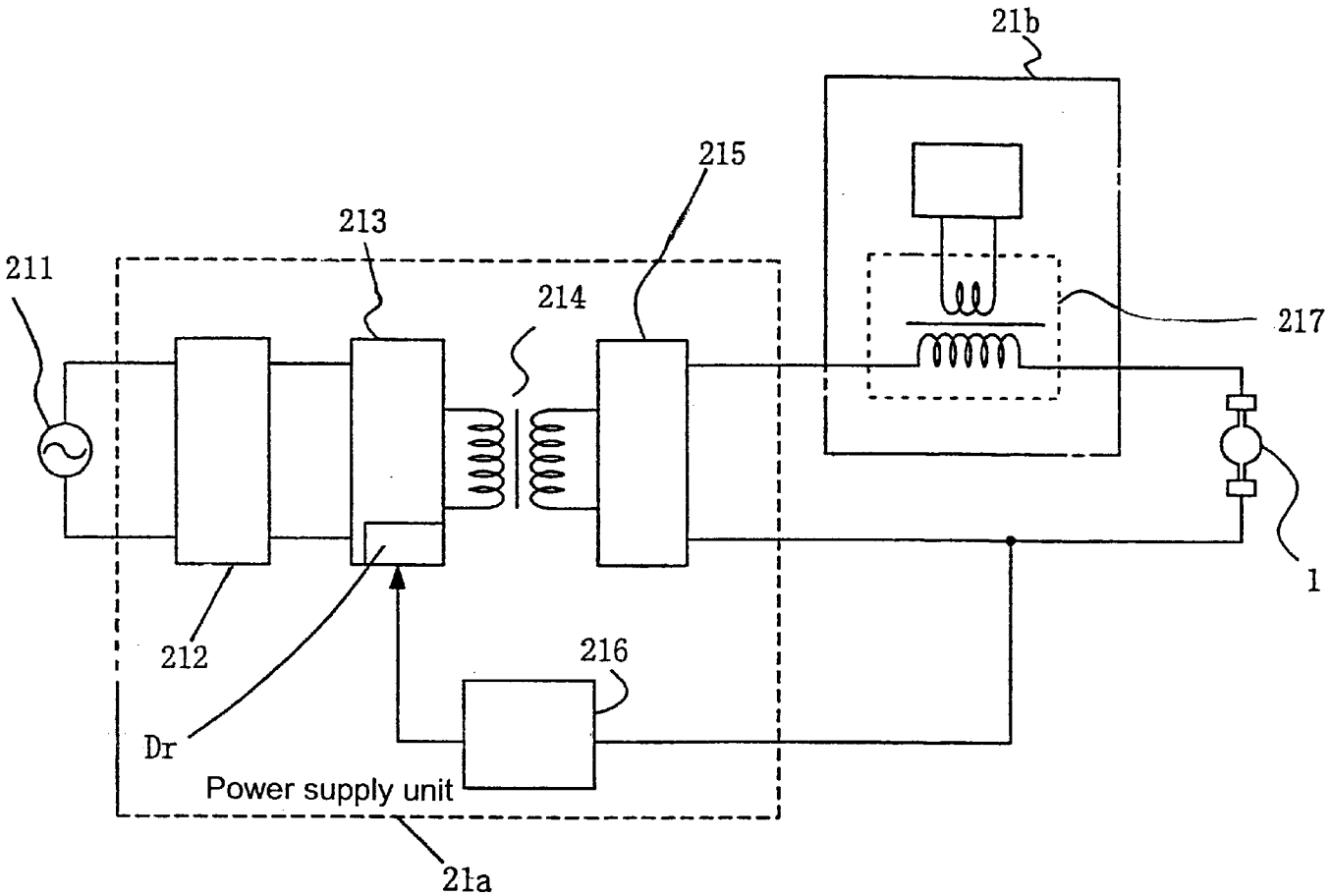
FIG. 2 is a diagram showing a power supply unit and a starter.

In FIG. 2, an example of the power supply unit 21*a* and the start-up circuit 21*b* are shown.

As shown in the figure, the power supply unit 21*a* has a primary rectifying/smoothing unit 212 for rectifying and smoothing the AD voltage supplied from the commercial power source 211, an inverter circuit 213 having a drive circuit Dr, a transformer 214 for boosting AC output of the inverter 213, a secondary rectifying/smoothing circuit 215 for rectifying output of the transformer 214, and a controlling circuit 216.

Thus, the AC voltage supplied from the commercial power source 211 is converted into DC voltage and is supplied to the lamp 1.

The controlling circuit 216 detects power supplied to the lamp 1 and controls the driving circuit Dr of the inverter circuit 213 so that power supplied to the lamp 1 is controlled to a desired value. The controlling circuit 216 may be included in the controlling unit 22 shown in FIG. 1.

On the output side of the power supply unit 21*a* is provided a starter 21*b* having a pulse transformer 217. The starter 21*b* generates high voltage for inducing dielectric breakdown between the electrodes of the lamp 1 at the start of lamp lighting.

In FIG. 1, the controlling unit 22 receives output of the accumulated light amount measuring unit 12 and the shutter opening/closing detecting sensor 63, and controls to turn on/off the lamp 1 by controlling the opening/closing of the shutter mechanism 6 or controlling the power supply unit 21*a*.

The controlling unit 22 controls the accumulated light amount to a fixed value as described below.

That is, during lighting of the lamp 1, the controller 22 outputs a shutter opening command to the shutter mechanism 6 to expose the light exposure surface. When the accumulated light exposure amount measured by the accumulated light amount measuring unit 12 reaches the predetermined value, the controlling unit 22 stops the emission of light onto the light exposure surface by outputting a lamp turning off command to the power supply 21*a*, and at the same time the controlling unit 22 outputs a shutter closing command to the shutter mechanism 6. After the shutter is closed and while the lamp 1 can be relighted, the controlling unit 22 output a lamp relighting command to the power supply unit 21*a*.

Figure 3:
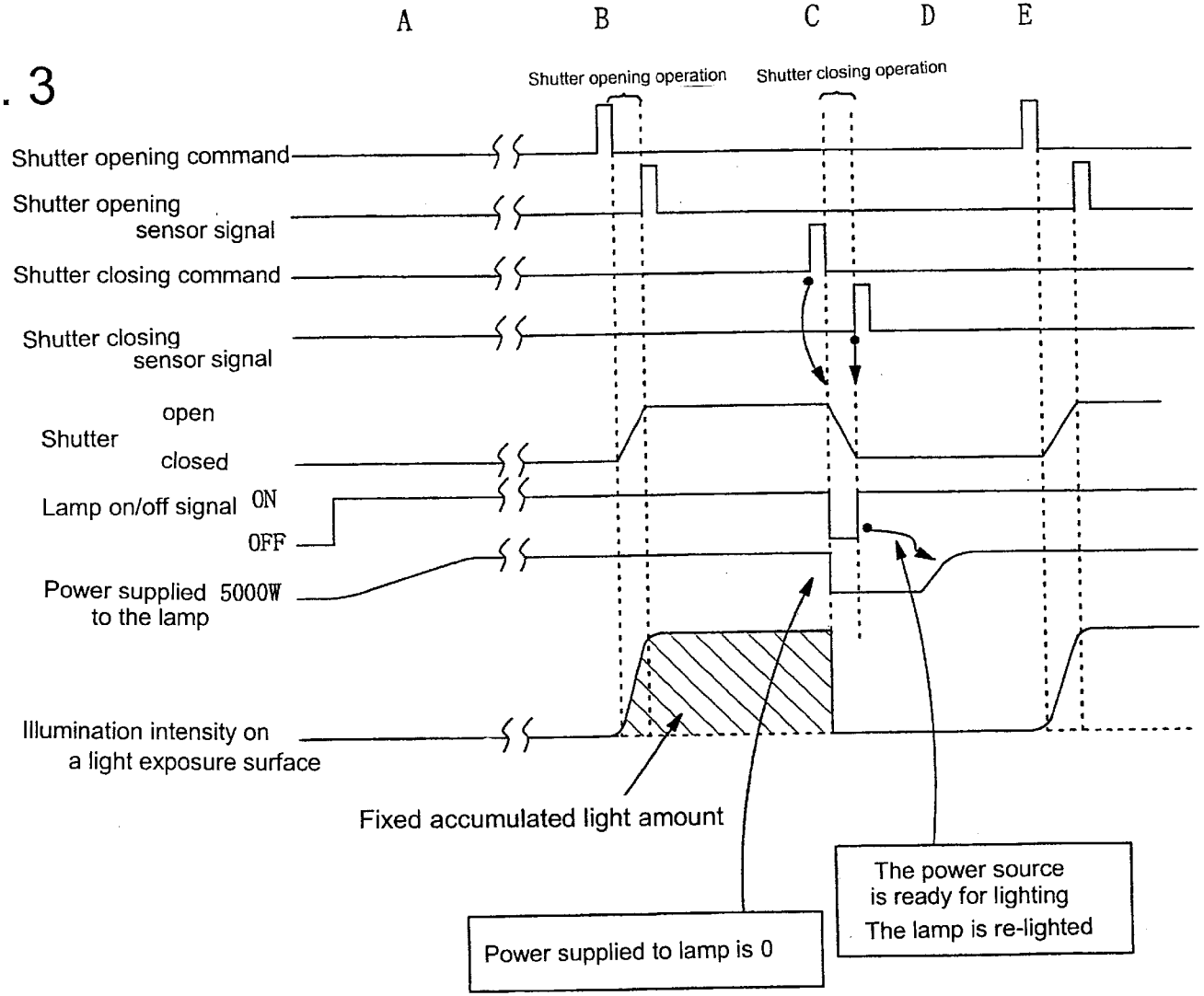
FIG. 3 is a timing chart of a shutter opening/closing signals, lamp ON/OFF signals, and illumination intensity on a light exposure surface etc. according to the present invention.

FIG. 3 is a timing chart of the shutter opening/closing commands and signals, lamp ON/OFF signals, and illumination intensity on a light exposure surface etc. according to the present invention.

In FIG. 3, according to the present invention control of accumulated light amount in a stepper will be explained by way of illustration.

Light exposure amount for exposing one of light exposure areas is input and stored in the controlling unit 22 beforehand.

According to the present invention, the accumulated light amount and the desired light exposure amount are compared with each other, and the lamp 1 is turned off when the accumulated light amount reaches the desired value. However, the accumulated light amount measuring unit 12 compares the accumulated light amount to the desired light exposure amount, and inform the controlling unit 22 that the accumulated light exposure amount reaches the desired light exposure amount, and, thereby the controlling unit 22 may turn off the lamp 1.

(a) The controlling unit 22 outputs a lamp turning on command to the power supply unit 21*a*. This causes the power supply unit 21*a* to supply power to the lamp 1 as shown as A in FIG. 3, the starter 21*b* to generate high voltage, and the lamp 1 to be turned on as shown as A in FIG. 3.

Since the lamp 1 is turned on after the lamp 1 is turned off for a long time, it takes 10 minutes for the lamp input to reach the rated apparent power and to be stabilized after dielectric breakdown between the electrodes takes place and the mercury inside the lamp 1 (mercury and other metals in case of a DeepUV lamp™) is evaporated as the lamp 1 is warmed up.

(b) When the lighting of the lamp 1 is stabilized, a wafer is conveyed to the processing unit of the light exposure apparatus and held on the work area after positioning. A light exposure ready signal is sent from the controlling section 23 of the light exposure apparatus to the controlling unit 22.

The conveyance of wafer may start before the lighting of the lamp 1 is stabilized and the wafer may wait for the stability of the lamp 1 on the work area.

(c) When the controlling unit 22 receives a light exposure ready signal, the controlling unit 22 sends a shutter opening command to the shutter driving unit 62 as shown as B in FIG. 3. The shutter plate 61 is brought into a shutter opening operation. Light is exposed on the light exposure surface and at the same time the illuminometer 11 receives the light. An illumination intensity signal from the illuminometer 11 is input in the accumulated light amount measuring unit 12, and converted into accumulated light exposure amount. The accumulated light exposure amount information is sent to the controlling unit 22.

(d) When the accumulated light exposure amount reaches a desired value, the controlling unit 22 sends a lamp OFF signal to the power supply unit 21*a* as shown as C in FIG. 3. The power supply unit 21*a* turns off the lamp 1.

A the same time when the controlling unit 22 outputs the lamp OFF signal, the controlling unit 22 sends a shutter closing command to the shutter driving unit 62.

When the lamp OFF signal from the controlling unit 22 stops an operation of the drive circuit Dr of the inverter circuit 213, in the power supply unit 21*a*, the power supplied to the lamp 1 drops to zero (0) within 1 ms and then the lamp 1 is turned off. The shutter starts a closing operation.

The controlling unit 22 does not necessarily output the lamp OFF signal and the shutter closing command to the shutter driving unit 62 at the same time. The controlling unit 22 may output the shutter closing command to the shutter driving unit 62 immediately after the controlling unit 22 sends the lamp OFF signal.

The bottom line is, the shutter must be closed while the lamp 1 is turned off but the lamp 1 can be relighted.

(e) As described above, the closing operation of the shutter plate 61 is completed for about 20 ms.

When the shutter is closed, a shutter closing sensor signal is sent to the controlling unit 22. When the controlling unit 22 receives the shutter closing sensor signal, the controlling unit 22 sends a lamp ON signal to the power supply unit 21*a*. In consideration of the 20 ms period for completing the closing operation, the lamp ON signal may be automatically sent in 20 ms or longer (for example 50 ms) after the shutter closing sensor signal is output.

(f) The drive circuit Dr of the inverter circuit 213 is operated by the lamp ON signal and the inverter circuit 213 starts to operate.

When output voltage from the power supply unit 21*a* reaches a desired voltage, the controlling unit 22 sends an ON signal to the starter (start-up circuit) 21*b* and high voltage is impressed to the lamp 1 through the pulse transformer 217 of the starter 21*b*. The lamp 1 is relighted as shown as D in FIG. 3.

Since in case of the relighting of the lamp 1, power is supplied to the lamp 1 in a state where vapor of mercury (mercury and other metals) remains, the relighting is stabilized in the same period as that of the turning off period of the lamp 1, which is different from the normal lighting as described above.

That is, if the turning off period is 20 ms, the period from the relighting to stabilization of the lamp 1 is about 20 ms. F Thus, the period for stabilization of the lamp 1 is significantly shortened comparing to the normal lighting.

(g) The period [lamp turning off→shutter closed 20 ms)→lamp relighting→lamp stabilization (20 ms)] is from 40 ms to 100~200 ms, during which a wafer is moved to the work area so that the next light exposure surface of the wafer is placed in a predetermined position by moving the work area. If necessary, positioning is carried out.

In case of the stepper, the conveying period of the light exposure surface is 0.5 seconds. Thus, even though the control of turning off and relighting is carried out, the control does not affect the throughput of the system since the conveying period about 0.5 seconds is sufficiently longer than the period from turning off to relighting and the stability of the lamp 1.

(h) Next, the light exposure ready signal is sent to the controlling unit 22, the controlling unit 22 repeats the operation from (c) described above as shown as E in FIG. 3.

Figure 4:
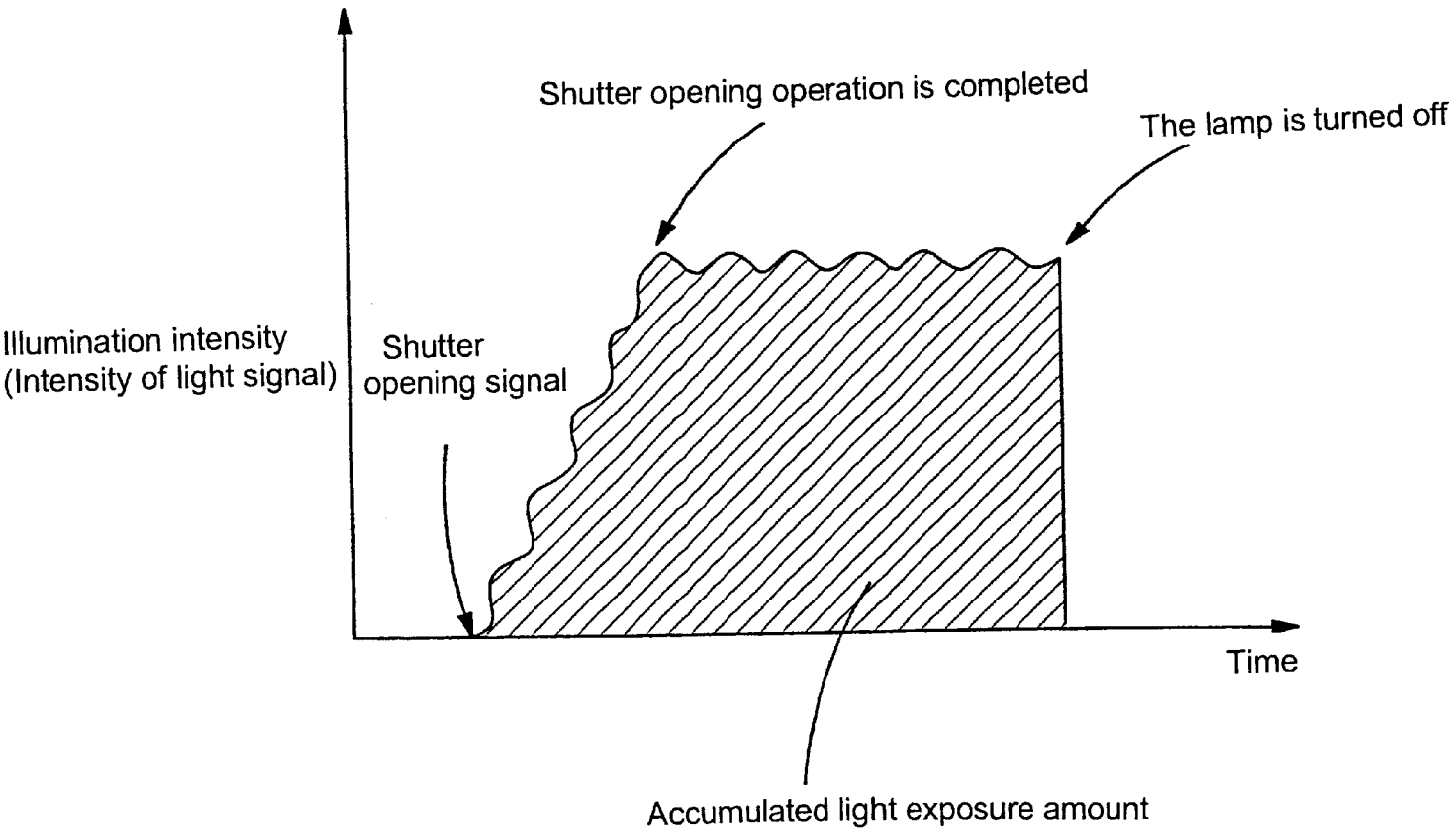
FIG. 4 is a graph showing change of illumination intensity on the light exposure surface during a period from closing of a shutter to turning off of the lamp according to the first embodiment of the present invention.

FIG. 4 is a graph showing change of illumination intensity on the light exposure surface (illumination intensity of a light signal measured by the illuminometer 11) in a period from opening of the shutter to turning off of the lamp 1 according to the present invention.

A portion marked with diagonal lines shows accumulated light exposure amount.

In the present embodiment, as described above, since the lamp 1 is turned off just after the accumulated light amount reaches a desired value, even if the light contains ripple as shown in FIG. 4, it is possible to precisely control light exposure amount on the light exposure surface without effect of the shutter closing period.

Since the lamp 1 is turned on after the shutter closing operation is completed, light in relighting of the lamp 1 is not emitted on the light exposure surface.

In the embodiment described above, although an example of the stepper to which the light emitting apparatus and the lamp lighting controlling apparatus are applied is described, the present invention may be applied to other apparatuses in which the accumulated light exposure amount on the work area is precisely controlled.

(a) The present invention may be applied to an overall exposure apparatus in which a wafer is exposed all at once and the wafer is replaced with an unprocessed wafer after the light exposure. In this case, the wafer replacing time is 2 to 3 seconds during which the lamp relighting is carried out.

(b) In addition to such a wafer, the work piece to which an exposure process is carried out may include but not limited to a display substrate such as a liquid crystal substrate.

In case of such a liquid crystal substrate, divided exposure areas on a substrate are exposed in order by moving the substrate or an entire surface of the substrate may be exposed all at once. The present invention may be applied to either type of exposure apparatus.

(c) The present invention may be applied to an exposure apparatus in which a long strip substrate is exposed. In case of such a long strip substrate, the substrate is conveyed by rollers during which relighting is carried out.

(d) In addition to formation of a circuit pattern on the resist, light exposure may be used for altering film quality by emitting ultra-violet rays on a film formed on a surface of a work piece or for attaching liquid crystal substrates by using UV cure adhesive.

In addition to an ultrahigh pressure mercury discharge lamp and xenon mercury discharge lamp, such a discharge lamp used for a light exposure apparatus in which accumulated light exposure amount exposed on a work piece is precisely controlled may include high-pressure mercury lamp, and metal halide lamp etc. In any of these lamps, mercury is included inside the lamp and ultra violet rays are emitted.

Next, a second embodiment according to the present invention will be described below.

In the second embodiment, illumination intensity on a light exposure surface is decreased by lowering power supplied to the lamp 1 to the rated apparent power during a shutter closing operation.

Figure 5:
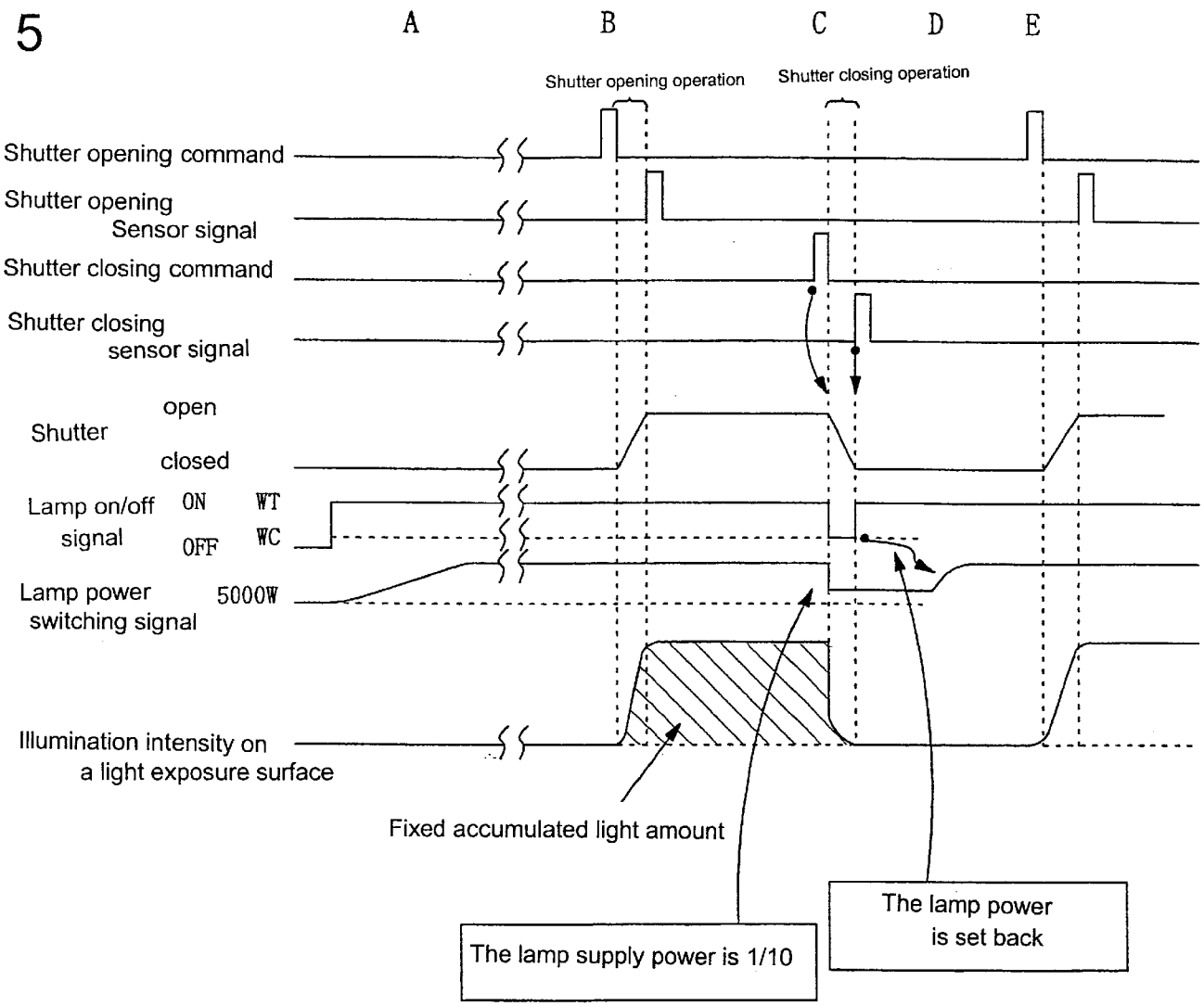
FIG. 5 is a schematic diagram of a light emission unit and a lamp lighting controlling apparatus according to a second embodiment of the present invention.

FIG. 5 is a schematic diagram of a light emission unit and a lamp lighting controlling apparatus according to the second embodiment of the present invention.

In FIG. 5, the same elements as those shown in FIG. 1 are numbered in the same manner.

A light emitting unit 10 is connected to a lamp lighting controlling apparatus 20 and a lamp lighting power source 21. The lamp lighting controlling apparatus has a controlling unit 22 therein. A light exposure controlling unit 23 is connected to the lamp lighting controlling apparatus 20.

In addition to the lamp 1, an illuminometer 11, an accumulated light amount measuring unit 12, a shutter mechanism 6, a shutter plate 61, and a shutter opening/closing detecting sensor 63, the light emitting unit 10 has, as shown in FIG. 8, optical components such as a condensing mirror 2 for condensing light from the discharge lamp 1, a first plane mirror 4 for reflecting light from the lamp 1 and the condensing mirror 2, an integrator lens 5 for making the illumination distribution uniform on the light exposure surface, a second plane mirror 7 for conducting light to a light outgoing window, and a collimator lens 8 for forming light emitted from the light outgoing window into parallel light.

The illuminometer 11 provided behind the second plane mirror 7, receives light through a light transmission portion such as a pinhole(s) provided on the second plane mirror 7. Output of the illuminometer 11 is sent to an accumulated light amount measuring unit 12. The accumulated light amount measuring unit 12 accumulates output of light amount measured by the illuminometer 11.

The shutter mechanism 6 is the same as that shown in FIG. 9, and in FIG. 5, the shutter opening/closing sensor 63 for detecting opening and closing of the shutter plate 61 is shown.

As described above, a work area is provided below a light outgoing window of the light emitting unit 10.

Exposure light is emitted on a certain light exposure area of a wafer on the work area through a mask (not shown) from the light emitting unit 10, and then light exposure process of the exposure area on the wafer is carried out.

The lamp lighting power source 21 for supplying power to turn on the lamp 1 has a power supply unit 21*a* and a start-up circuit 21*b* (a starter). The power supply unit 21*a* converts AC from an AC commercial power source into DC and controls power supplied to the lamp 1.

The start-up circuit 21*b* generates high voltage so that dielectric breakdown takes place between electrodes of the lamp 1 at the start of discharge lamp lighting.

The structure of the power supplying unit 21*a* and the start-up circuit 21*b* is the same as that shown in FIG. 2.

A drive circuit Dr of an inverter circuit 213 in FIG. 2 lowers voltage supplied to the lamp 1 according to the power reducing signal or sets the lowered voltage back to the rated apparent voltage according the a power increasing signal.

The controlling unit 22 controls power supplied to the lamp 1 by controlling opening of the shutter mechanism 6 or the lamp lighting power source 21*a*, based on output from a controlling section 23 for controlling the exposure apparatus, the accumulated light amount measuring unit 12, and the shutter opening/closing detecting sensor 63.

The controlling unit 22 controls them so that the accumulated light exposure amount is controlled to a desired value as described below.

That is, for example if n is 10, assuming that, as described above, that 1/10 of exposure amount A during a shutter opening operation and the exposure amount B in a shutter closing operation are equal [(1/10)×A=B], during the lamp lighting operation, a shutter opening command is sent to the shutter driving unit 62 and the light exposure surface is exposed. When the accumulated light exposure amount measured by the accumulated light amount measuring unit 12 from the start of the shutter opening operation, reaches a certain exposure amount which is less than the predetermined exposure amount by (1/10)×A, a lamp power switching signal for reducing power supplied to the discharge lamp 1 to a desired power less than the rated apparent power (a signal for switching power to 1/10) is sent to the power supply unit 21*a* so that intensity of light emission onto the light exposure surface is decreased (1/n). At the same time, a shutter closing command is sent to the shutter mechanism 6.

After the shutter closing operation is completed, the power supplied to the lamp is increased to the rated apparent power before the lamp is turned off.

Figure 6:
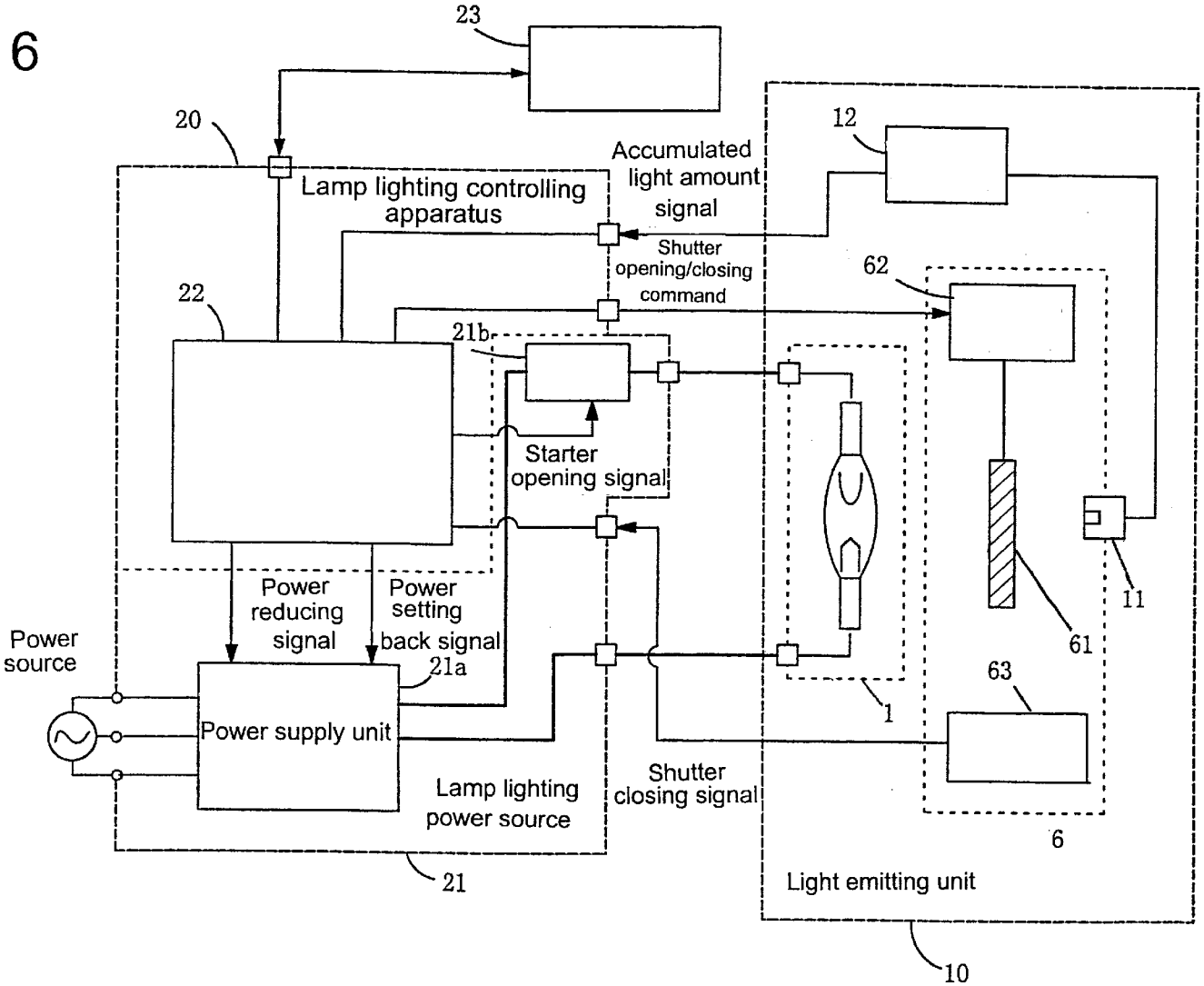
FIG. 6 is a timing chart of a shutter opening/closing signals, lamp ON/OFF signals, and illumination intensity on a light exposure surface etc. according to a second embodiment of the present invention.

FIG. 6 is a timing chart of the shutter opening/closing commands and signals, a lamp power switching signal, and illumination intensity on a light exposure surface etc. according to the present invention.

In FIG. 6, according to the present invention, control of accumulated light amount in a stepper will be given by way of illustration.

(a) Light exposure amount R for exposing one of light exposure areas, the lamp rated apparent power WT and lamp power WC at a time of a shutter closing operation are input in the controlling unit 22 beforehand. The controlling unit 22 stores a desired light exposure amount, and calculates power WC at the time of shutter closing operation to the lamp rated apparent power WT ratio WC/WT.

The power WC at a time of the shutter closing operation to the rated apparent power WT ratio depends on how much fluctuation of light exposure amount which is predicted at the shutter closing operation is reduced Since the illumination intensity on the light exposure surface is proportional to the lamp power, if the lamp power is decreased, then the illumination intensity decreases and fluctuation of illumination intensity by ripple is reduced and fluctuation of light exposure amount caused by fluctuation of shutter operation time is also reduced. That is, since light exposure amount=illumination intensity×time, the illumination intensity is decreased.

However, if the lamp power is lowered too much, discharge is not maintained and the lamp is sometimes turned off.

In the present circumstances, if the shutter closing operation time is about 20 ms, even though the lamp power is lowered to about 1/10, it is possible to sufficiently maintain the discharge.

As described above, although it is possible to relight the lamp within 4 seconds from a time when the lamp is turned off, in the second embodiment, it would be possible to maintain discharge for 7 to 8 seconds.

(b) The controlling unit 22 outputs a lamp turning on command to the lamp lighting power source 21. This causes the power supply unit 21*a* to supply power to the lamp 1 as shown FIG. 6, the starter 21*b* to generate high voltage, and the lamp 1 to turn on as shown as A in FIG. 6.

Since the lamp 1 is turned on after the lamp 1 is turned off for a long time, it takes about 10 minutes for the lamp input to reach the rated apparent power WT and to be stabilized after dielectric breakdown between the electrodes takes place and the mercury inside the lamp 1 (mercury and other metals in case of a DeepUV lamp™) is evaporated as the lamp 1 is warmed up.

(c) When the lighting of the lamp 1 is stabilized, a wafer is conveyed to the processing unit of the light exposure apparatus and held on the work area after positioning. A light exposure ready signal is sent from the controlling section 23 of the light exposure apparatus to the controlling unit 22.

The conveyance of wafer may starts before the lighting of the lamp 1 is stabilized and then the wafer may wait for stabilization of the lamp 1 on the work area.

(d) When the controlling unit 22 receives the light exposure ready signal, the controlling unit 22 sends a shutter opening command to the shutter driving unit 62 as shown as B in FIG. 6. The shutter plate 61 is brought into an opening operation. Light is exposed on the light exposure surface and at the same time the illuminometer 11 receives the light. An illumination intensity signal from the illuminometer 11 is input in the accumulated light amount measuring unit 12, and converted into accumulated light exposure amount. The accumulated light exposure amount information is sent to the controlling unit 22.

(e) The controlling unit 22 stores light exposure amount A measured when the shutter opening operation of the shutter plate 61 is carried out.

The controlling unit 22 multiplies the light exposure amount A during of the shutter plate opening operation by WC/WT (power at the shutter closing operation to lamp rated apparent power ratio) to calculate light exposure amount B during the shutter closing operation (=WC/WT×A).

The controlling unit 22 subtracts the light exposure amount B (=WC/WT×A) from the desired light exposure amount R to calculate accumulated light exposure amount at a time of outputting the lamp power switching signal and the shutter closing command (R−B=R−WC/WT×A).

(f) When the accumulated light exposure amount reaches (R−WC/WT×A), the controlling unit 22 sends, to the power supply unit 21*a*, a power switching signal (a power reducing signal) for switching the lamp power from the rated apparent power WT to WC less than WT. The lamp power supply unit 21*a* switches power supplied to the lamp 1 to WC as shown as C in FIG. 6.

At the same time when the controlling unit 22 outputs the lamp power switching signal (power reducing signal) to the power supply unit 21*a*, the controlling unit 22 sends a shutter closing command to the shutter driving unit 62.

(g) According to the lamp power switching signal (power reducing signal) from the controlling unit 22, a drive circuit Dr of an inverter circuit 213 is controlled so that power supplied to the lamp 1 is WC. In particular, for example, the frequency and pulse width of the inverter are changed so that power supplied to the lamp 1 is WC. It takes less than 1 ms to switch power supplied to the lamp 1 and the shutter closing operation is carried out.

(h) As described above, the closing operation of the shutter plate 61 is completed for about 20 ms.

When the shutter is closed, a shutter opening sensor signal is sent to the controlling unit 22. When the controlling unit 22 receives the shutter opening sensor signal, the controlling unit 22 sends the lamp power switching signal (power setting back signal) to the power supply unit 21*a* in a predetermined period, during which the discharge in the lamp 1 can be maintained as shown as D in FIG. 6. Thereby, the rated apparent power is applied to the lamp 1 again.

At that time, if the waiting period to perform the next light exposure operation is long and the shutter is closed for a long time, without applying the rated apparent power WT to the lamp 1, it is possible to maintain a stand-by state by applying 70 to 80% of the rated apparent power to the lamp 1.

Although conventionally, as described above, standby-lighting in which 70 to 80% of the rated apparent power is applied to the lamp, is used, the stand-by-lighting is to lower power supplied to the lamp 1 to maintain the lighting for a long time, it is not to lower power in view of fluctuation of a light exposure amount caused by light exposure fluctuation during the shutter closing operation.

On the contrary, in the present invention, power is lowered during the shutter closing operation so that an error of light exposure amount falls within a tolerance. Since it is difficult to maintain the lighting for a long time with such power, the power is increased before the lamp 1 fails to maintain the discharge of the lamp 1. Thus, the technology of the present invention is different from the stand-by-lighting.

(i) After the shutter is closed, the next area on the wafer is positioned for light exposure by moving the work area. If necessary, positioning is carried out. A light exposure ready signal is sent to the controller 22. The controller 22 repeats the operation from (d) as shown as E in FIG. 6.

In the description, when the accumulated light exposure amount reaches (R−WC/WT×A), a power reducing signal is sent to the power supply unit 21*a* and at the same time the shutter closing command is sent. Since the light exposure amount (WC/WT×A) during the shutter closing operation is small, if the light exposure amount does not become problematic, it is possible to output the shutter closing command and the power reducing signal at the same time.

Figure 7:
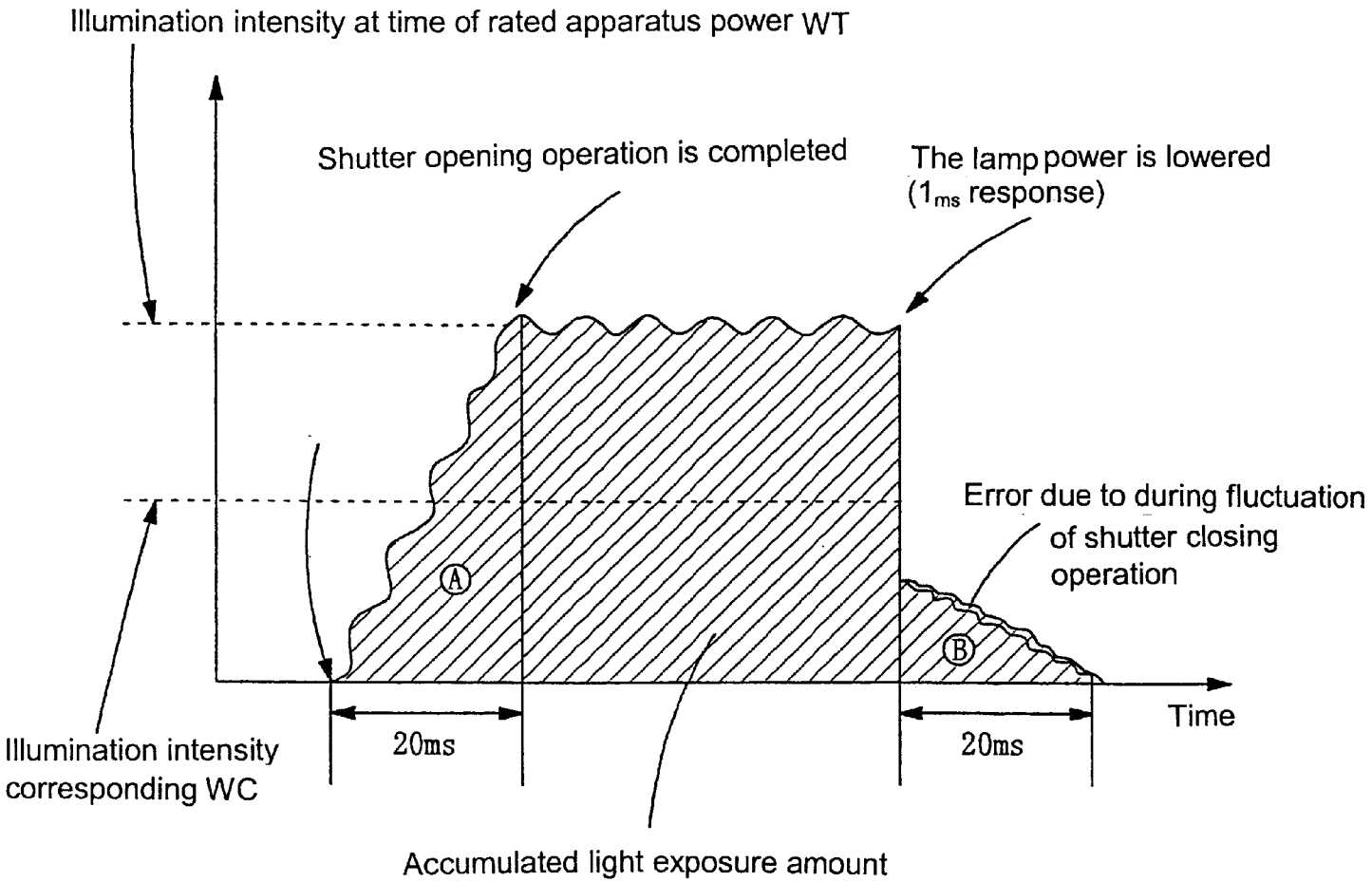
FIG. 7 is a graph showing change of illumination intensity on the light exposure surface during a period from closing of shutter to turning off of the lamp according to the second embodiment of the present invention.

FIG. 7 is a graph showing change of illumination intensity on the light exposure surface in a period from closing of shutter to turning off of the lamp (intensity change of a light signal measured by the illuminometer 11) according to the second embodiment of the present invention.

In the figure, a portion marked with diagonal lines shows accumulated light amount.

In the present embodiment, as described above, the accumulated light exposure amount reaches (R−WC/WT×A), power applied to the lamp 1 is switched to power WC less than the rated apparent power WT. Therefore, the ripple of light caused during the shutter closing operation or change of accumulated light amount caused by fluctuation of the shutter closing/operation time is compressed to WC/WT which is less than conventional one. Therefore, it is possible to more precisely control light exposure amount on the light exposure surface than in conventional method.

In the embodiment described above, although an example of the stepper to which the light emitting apparatus and the lamp lighting controlling apparatus are applied is described, the present invention may be applied to other apparatuses if the accumulated light exposure amount on the work area is precisely controlled as well as the first embodiment.

(a) The present invention may be applied to an overall exposure apparatus in which a wafer is exposed all at once and the wafer is replaced with an unprocessed wafer after the light exposure.

(b) In addition to such a wafer, the work piece to which an exposure process is carried out may be but not limited to a display substrate such as a liquid crystal substrate.

In case of such a liquid crystal substrate, divided exposure areas on a substrate are exposed in order by moving the substrate or an entire surface of the substrate may be exposed all at once. The present invention may be applied to either type of exposure apparatus.

(c) The present invention may be applied to an exposure apparatus in which a long strip substrate is exposed. In case of such a long strip substrate, the substrate is conveyed by rollers during which relighting is carried out.

(d) In addition to formation of a circuit pattern on the resist, light exposure may be used for altering film quality by emitting ultra-violet rays on a film formed on a surface of a work piece or for attaching liquid crystal substrates by using UV cure adhesive.

Thus, the present invention has the following effects:

(a) Since the lamp 1 is turned off immediately after the accumulated light amount reaches a desired value, it is possible to eliminate uncontrollable light exposure amount generated in a period from the start of shutter closing to the completion of the closing. Further, even though ripple is contained in light, it is possible to precisely control the light exposure amount on the light exposure surface.

Therefore, it is possible to eliminate fluctuation of light exposure amount and to accurately perform light exposure amount control.

(b) Since when the accumulated light exposure amount reaches a desired amount or a certain amount less than the desired value by light amount at time of shutter closing, the lamp power is switched from the rated apparent power to power less than the rated apparent power, illumination intensity on the light exposure surface is lowered by that amount. Since the shutter closing operation is carried out in such a manner, it is possible to reduce fluctuation of light exposure amount generated in the period from the beginning of shutter closing to the completion of the closing in comparison with that in case that the lamp continues to light on with the rated apparent power. Therefore, it is possible to precisely control light exposure amount.

Specifically, when the power supplied to the lamp 1 is lowered and the lighting is maintained, the limit that relighting must be carried out during time when the relighting is possible is eliminated, therefore, design freedom is increased as to the light exposure process control of an apparatus. It is not necessary to relight the lamp by impressing high voltage to the lamp by the starter (start-up circuit). Therefore, it is possible to reduce the load on the discharge lamp electrodes. Since it is not necessary to impress high voltage to the electrodes by the starter, it is possible to reduce electromagnetic nose and it is possible to reduce necessity of a noise cut filter.

The disclosure of Japanese Patent Application Nos. 2002-158978 filed May 31, 2002 and 2003-75157 filed Mar. 19, 2003 including specification, drawings and claims is incorporated herein by reference in its entirety.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. A lamp lighting controlling apparatus applied to a light emitting unit having a lamp for emitting light on a light exposure surface, a shutter provided on an optical path between the lamp and the light exposure surface, a shutter mechanism that opens the shutter when the shutter mechanism receives a shutter opening command and closes the shutter when the shutter mechanism receives a shutter closing command, an accumulated light amount measuring unit in which accumulated light amount is measured, the lamp lighting controlling apparatus comprising:

a lamp lighting power source for supplying power to the lamp; and a controller in which based on output of the accumulate light amount measuring unit, the shutter mechanism and the lamp lighting power source is controlled, wherein the controller sends the shutter opening command to the shutter mechanism while the lamp is turned on so that light is emitted on the light exposure surface, the controller sends a lamp turning off command to the lamp lighting power source when the accumulated light amount measured by the accumulated light amount measuring unit reaches a predetermined value, so that emission of the light is stopped, and the controller sends the shutter closing command to the shutter mechanism, and the controller sends a lamp relighting command to the lamp lighting power source after the shutter is closed and while relighting of the lamp is possible.

2. The lamp lighting controlling apparatus according to claim 1, wherein the controller does not relight the lamp at least while the shutter is in a closing operation.

3. A lamp lighting controlling apparatus comprising:

a lamp for emitting light on a light exposure surface;

a shutter provided on an optical path between the lamp and the light exposure surface;

a shutter mechanism that opens the shutter when the shutter mechanism receives a shutter opening command and closes the shutter when the shutter mechanism receives a shutter closing command;

an accumulated light amount measuring unit in which accumulated light amount is measured;

a lamp lighting source power source for supplying power to the lamp; and a controller in which based on output of the accumulate light amount measuring unit, the shutter mechanism and the lamp lighting power source is controlled, wherein the controller sends the shutter opening command to the shutter mechanism while the lamp is turned on so that light is emitted on the light exposure surface, the controller sends a lamp turning off command to the lamp lighting power source when the accumulated light amount measured by the accumulated light amount measuring unit reaches a predetermined value, so that emission of the light is stopped, and the controller sends the shutter closing command to the shutter mechanism, and the controller sends a lamp relighting command to the lamp lighting power source after the shutter is closed and while relighting of the lamp is possible.

4. A lamp lighting controlling apparatus applied to a light emitting unit having a lamp for emitting light on a light exposure surface, a shutter provided on an optical path between the lamp and the light exposure surface, a shutter mechanism that opens the shutter when the shutter mechanism receives a shutter opening command and closes the shutter when the shutter mechanism receives a shutter closing command, an accumulated light amount measuring unit in which accumulated light amount is measured, the lamp lighting controlling apparatus comprising:

a lamp lighting source power source for supplying power to the lamp; and a controller in which based on output of the accumulate light amount measuring unit, the shutter mechanism and the lamp lighting power source is controlled, wherein the controller sends the shutter opening command to the shutter mechanism while the lamp is turned on so that light is emitted on the light exposure surface, the controller sends a power reducing command to the lamp lighting power source when the accumulated light amount measured by the accumulated light amount measuring unit reaches a predetermined value or value less than the predetermined value by light exposure amount during a shutter closing operation, so that illumination intensity on the light exposure surface is lowered, and the controller sends the shutter closing command to the shutter mechanism, and the controller sends a power increasing command to the lamp lighting power source before the lamp is turned off.

5. A lamp lighting controlling apparatus according to claim 4, wherein the power is not increasing at least during the shutter closing operation.

6. A lamp lighting controlling apparatus comprising:

a lamp for emitting light on a light exposure surface;

a shutter provided on an optical path between the lamp and the light exposure surface;

a shutter mechanism that opens the shutter when the shutter mechanism receives a shutter opening command and closes the shutter when the shutter mechanism receives a shutter closing command, an accumulated light amount measuring unit in which accumulated light amount is measured a lamp lighting source power source for supplying power to the lamp; and a controller in which based on output of the accumulate light amount measuring unit, the shutter mechanism and the lamp lighting power source is controlled, wherein the controller sends the shutter opening command to the shutter mechanism while the lamp is turned on so that light is emitted on the light exposure surface, the controller sends a power reducing command to the lamp lighting power source when the accumulated light amount measured by the accumulated light amount measuring unit reaches a predetermined value or value less than the predetermined value by light exposure amount during a shutter closing operation, so that illumination intensity on the light exposure surface is lowered, and the controller sends the shutter closing command to the shutter mechanism, and the controller sends a power increasing command to the lamp lighting power source before the lamp is turned off.

* * * * *